US006918201B1

(12) United States Patent
Guillory

(10) Patent No.: US 6,918,201 B1
(45) Date of Patent: Jul. 19, 2005

(54) METHOD OF INCREASING THE FIRING RATE OF A MUZZLE LOADED BLACK POWDER RIFLE AND A RIFLE FOR PRACTICING SAME

(76) Inventor: Gerald L. Guillory, 17384 Lauren Dr., Prairieville, LA (US) 70769

( * ) Notice: Subject to any disclaimer, the term of this patent is extended or adjusted under 35 U.S.C. 154(b) by 0 days.

(21) Appl. No.: 10/391,980

(22) Filed: Mar. 19, 2003

(51) Int. Cl.[7] ..... F41C 7/00
(52) U.S. Cl. ..... 42/51
(58) Field of Search ..... 42/90, 59, 51

(56) References Cited

U.S. PATENT DOCUMENTS 6,945 A * 12/1849 Perry ..... 42/27
3,830,001 A * 8/1974 Sefried, II ..... 42/59
4,094,098 A * 6/1978 Gourley ..... 42/90
4,442,620 A * 4/1984 Drake et al. ..... 42/90
4,589,220 A * 5/1986 Lofland ..... 42/90
4,607,446 A * 8/1986 Scheuring ..... 42/90
5,081,781 A * 1/1992 Kanyuck et al. ..... 42/90
5,092,072 A * 3/1992 Fritts ..... 42/90
5,182,412 A * 1/1993 Mazza ..... 42/90
2004/0103574 A1 * 6/2004 Williams et al. ..... 42/51

* cited by examiner

*Primary Examiner*—Michael J. Carone
*Assistant Examiner*—Troy Chambers
(74) *Attorney, Agent, or Firm*—Roy, Kiesel, Keegan & DeNicola

(57) ABSTRACT

A method of achieving an increased muzzle loaded, black powder hunting rifle firing rate and a muzzle loaded black powder hunting rifle used to practice the increased muzzle loaded, black powder rifle firing rate method of the invention.

2 Claims, 3 Drawing Sheets

METHOD OF INCREASING THE FIRING RATE OF A MUZZLE LOADED BLACK POWDER RIFLE AND A RIFLE FOR PRACTICING SAME

TECHNICAL FIELD

The present invention relates to muzzle loaded black powder hunting rifles and a method of achieving an increased muzzle, loaded, black powder hunting rifle firing rate as well as a muzzle loaded black powder hunting rifle that is used to practice the method; the method of achieving an increased muzzle loaded black powder hunting rifle firing rate includes the steps of a) providing a muzzle loaded black powder hunting rifle that includes a rifle barrel having a projectile bore provided with a load chamber connecting bore end and a muzzle end; a moveable, muzzle loaded black powder load chamber structure having multiple muzzle loaded black powder load chamber structures formed therein each including a separate primer cap holding structure end having a primer cap holding structure provided in connection therewith, a projectile load chamber for holding a quantity of muzzle loaded, black powder projectile propellant and a projectile, and a chamber projectile ejection opening end; the moveable, muzzle loaded, black powder load chamber structure being held in connection with a load chamber alignment and locking structure that allows a user to selectively, rapidly, functionally connect the chamber projectile ejection opening of one of the multiple muzzle loaded black powder load chamber structures with the projectile receiving bore end of the rifle barrel projectile bore and the corresponding primer cap holding structure end of the selected one of the multiple muzzle loaded black powder load chamber structures such that the primer cap holding structure is located in the striking path of a firing pin of the muzzle loaded black powder hunting rifle adapted for striking and igniting a primer cap seated on the primer cap holding structure in a manner to ignite a quantity of muzzle loaded black powder projectile propellant within the projectile load chamber causing the projectile to be fired from the projectile load chamber out of the muzzle end of the rifle barrel bore; b) positioning the chamber projectile ejection opening of each of the multiple muzzle loaded black powder load chamber structures in connection with the projectile receiving bore end of the rifle barrel projectile bore and loading each of the projectile load chambers with a muzzle loaded black powder load through the muzzle end of the rifle barrel bore; c) positioning a primer cap in connection with the primer cap holding structure provided at a primer cap holding structure end of the selected one of the multiple muzzle loaded black powder load chamber structures; d) moving the muzzle loaded black powder load chamber structure to functionally connect the first one of the multiple muzzle loaded black powder load chamber structures to be fired with the projectile receiving bore end of the rifle barrel projectile bore; e) causing the firing pin of the muzzle loaded black powder hunting rifle to strike the primer cap seated on the primer cap holding structure of the first one of the multiple muzzle loaded black powder load chamber structures firing the first one of the multiple muzzle loaded black powder load chamber structures; f) moving the muzzle loaded black powder load chamber structure to functionally connect a second one of the multiple muzzle loaded black powder load chamber structures to be fired with the projectile receiving bore end of the rifle barrel projectile bore; g) causing the firing pin of the muzzle loaded black powder hunting rifle to strike the primer cap seated on the primer cap holding structure of the next one of the multiple muzzle loaded black powder load chamber structures firing the next one of the multiple muzzle loaded black powder load chamber structures; and h) repeating steps f) and g) until the desired number or all of the multiple muzzle loaded black powder load chamber structures have been fired.

BACKGROUND ART

Muzzle loaded black powder hunting rifle use has increased recently because most hunting jurisdictions have special game hunting seasons where only muzzle loaded, black powder hunting rifles may be used to harvest the particular game animal, such as a white tail deer. Because muzzle loaded black powder hunting riles are less accurate than cartridge firing rifles, deliver less killing power than cartridge firing rifles, have less range than a cartridge firing rifle and take considerably longer to reload and fire than a cartridge firing rifle; many deer are shot and injured by projectiles fired from a muzzle loaded black powder hunting rifle escape and elude the hunter. This occurs because the hunter does not have adequate time to reload and deliver a second fatal shot to the injured animal before the injured animal dashes off into the woods to suffer a slow, painful death at a hidden location never to be found by the hunter even after hours of diligent searching. It would be desirable, therefore, to have a method of achieving an increased muzzle loaded black powder hunting rifle firing rate. It would also be desirable to have a muzzle loaded black powder hunting rifle that could be used to practice the increased rifle firing rate method.

GENERAL SUMMARY DISCUSSION OF INVENTION

It is thus an object of the invention to provide a method of increasing the firing rate of a muzzle loaded, back powder hunting rifle that includes the steps of: a) providing a muzzle loaded black powder hunting rifle that includes a rifle barrel having a projectile bore provided with a load chamber connecting bore end and a muzzle end; a moveable, muzzle loaded black powder load chamber structure having multiple muzzle loaded black powder load chamber structures formed therein each including a separate primer cap holding structure end having a primer cap holding structure provided in connection therewith, a projectile load chamber for holding a quantity of muzzle loaded, black powder projectile propellant and a projectile, and a chamber projectile ejection opening end; the moveable, muzzle loaded, black powder load chamber structure being held in connection with a load chamber alignment and locking structure that allows a user to selectively, rapidly, functionally connect the chamber projectile ejection opening of one of the multiple muzzle loaded black powder load chamber structures with the projectile receiving bore end of the rifle barrel projectile bore and the corresponding primer cap holding structure end of the selected one of the multiple muzzle loaded black powder load chamber structures such that the primer cap holding structure is located in the striking path of a firing pin of the muzzle loaded black powder hunting rifle adapted for striking and igniting a primer cap seated on the primer cap holding structure in a manner to ignite a quantity of muzzle loaded black powder projectile propellant within the projectile load chamber causing the projectile to be fired from the projectile load chamber out of the muzzle end of the rifle barrel bore; b) positioning the chamber projectile ejection opening of each of the multiple muzzle loaded black powder load chamber structures in connection with the projectile receiving bore end of the rifle barrel projectile bore and loading each of the projectile load chambers with a muzzle loaded black powder load through the muzzle end of the rifle barrel bore; c) positioning a primer cap in connection with the primer cap holding structure provided at a primer cap holding structure end of the selected one of the multiple muzzle loaded black powder load chamber structures; d) moving the muzzle loaded black powder load chamber structure to functionally connect the first one of the multiple muzzle loaded black powder load chamber structures to be fired with the projectile receiving bore end of the rifle barrel projectile bore; e) causing the firing pin of the muzzle loaded black powder hunting rifle to strike the primer cap seated on the primer cap holding structure of the first one of the multiple muzzle loaded black powder load chamber structures firing the first one of the multiple muzzle loaded black powder load chamber structures; f) moving the muzzle loaded black powder load chamber structure to functionally connect a second one of the multiple muzzle loaded black powder load chamber structures to be fired with the projectile receiving bore end of the rifle barrel projectile bore; g) causing the firing pin of the muzzle loaded black powder hunting rifle to strike the primer cap seated on the primer cap holding structure of the next one of the multiple muzzle loaded; black powder load chamber structures firing the next one of the multiple muzzle loaded black powder load chamber structures; and h) repeating steps f) and g) until the desired number or all of the, multiple muzzle loaded black powder load chamber structures have been fired.

It is still a further object of the invention to provide a muzzle loaded black powder hunting rifle usable to practice the method of the invention that includes a rifle barrel having a projectile bore provided with a load chamber connecting bore end and a muzzle end; a moveable, muzzle loaded black powder load chamber structure having multiple muzzle loaded black powder load chamber structures formed therein each including a separate primer cap holding structure end having a primer cap holding structure provided in connection therewith, a projectile load chamber for holding a quantity of muzzle loaded, black powder projectile propellant and a projectile, and a chamber projectile ejection opening end; the moveable, muzzle loaded, black powder load chamber structure being held in connection with a load chamber alignment and locking structure that allows a user to selectively, rapidly, functionally connect the chamber projectile ejection opening of one of the multiple muzzle loaded black powder load chamber structures with the projectile receiving bore end of the rifle barrel projectile bore and the corresponding primer cap holding structure end of the selected one of the multiple muzzle loaded black powder load chamber structures such that the primer cap holding structure is located in the striking path of a firing pin of the muzzle loaded black powder hunting rifle adapted for striking and igniting a primer cap seated on the primer cap holding structure in a manner to ignite a quantity of muzzle loaded black powder projectile propellant within the projectile load chamber causing the projectile to be fired from the projectile load chamber out of the muzzle end of the rifle barrel bore.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

Exemplary Mode for Carrying Out the Invention

Figure 1:
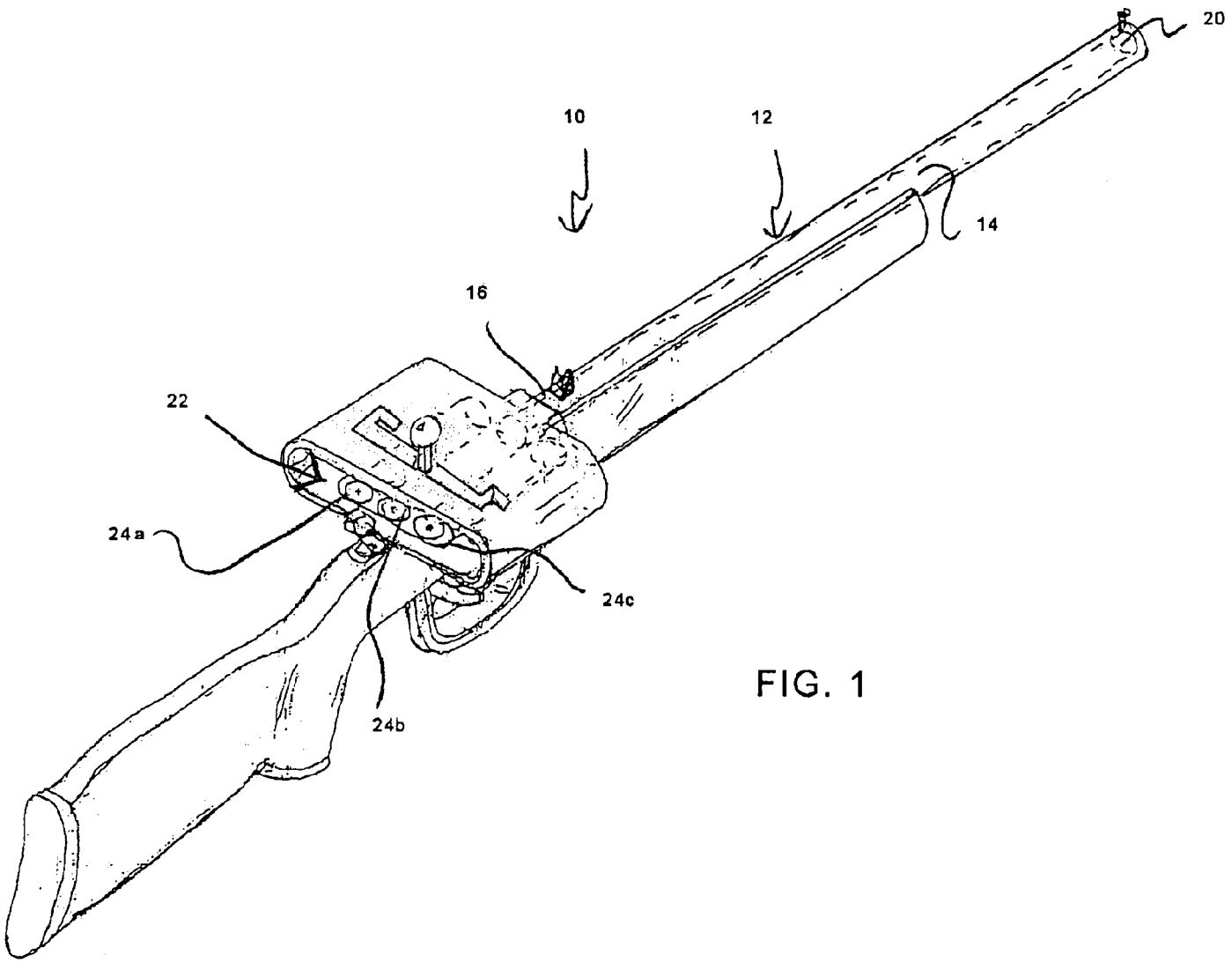
FIG. 1 is a perspective view of an exemplary embodiment of muzzle loaded black powder hunting rifle usable to practice the method of the invention.
Figure 2:
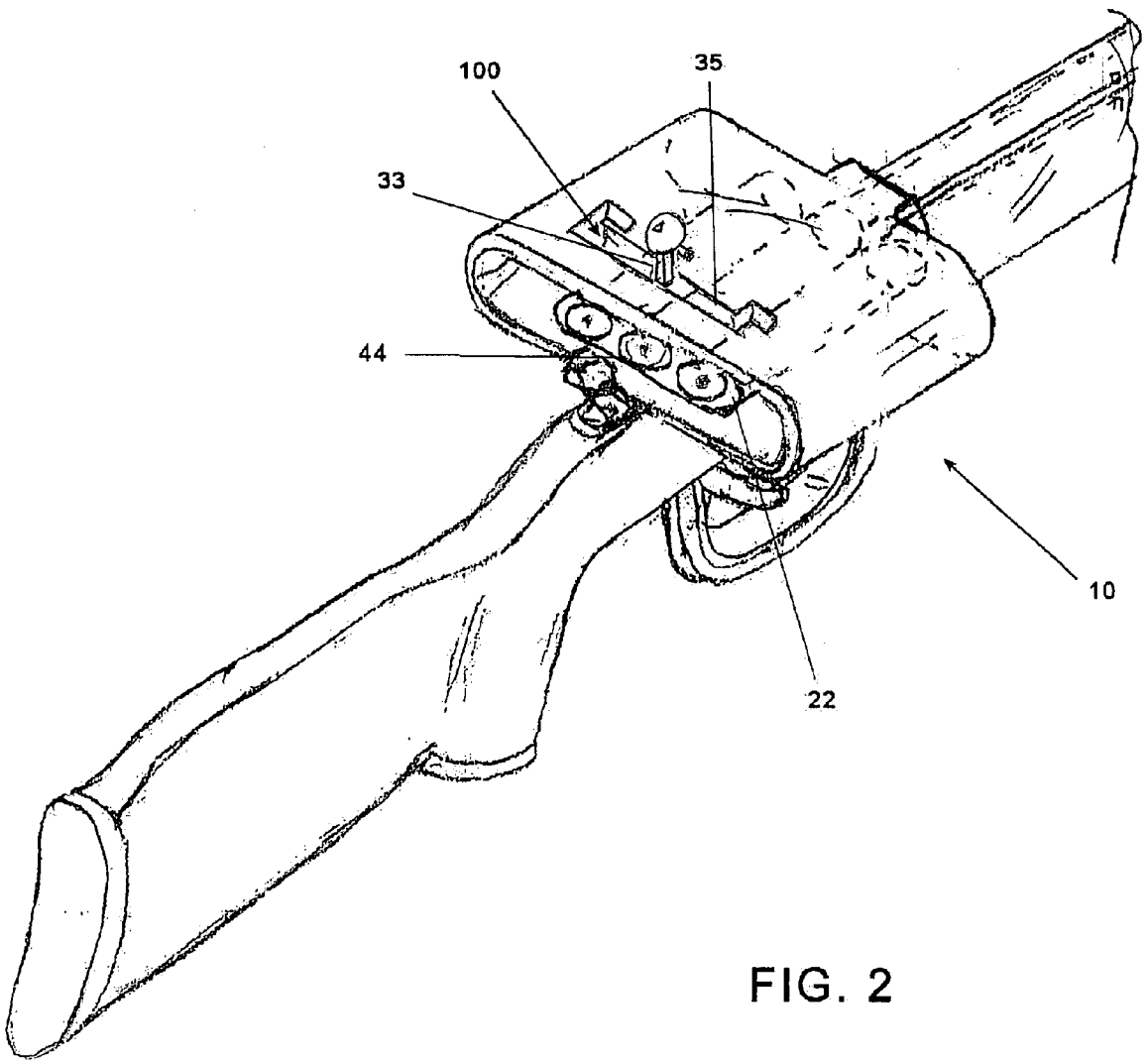
FIG. 2 is a detail perspective view of an exemplary moveable, muzzle loaded, black powder load chamber structure of the exemplary rifle of FIG. 1 held within an exemplary load chamber alignment and locking mechanism of the exemplary rifle of FIG. 1.
Figure 3:
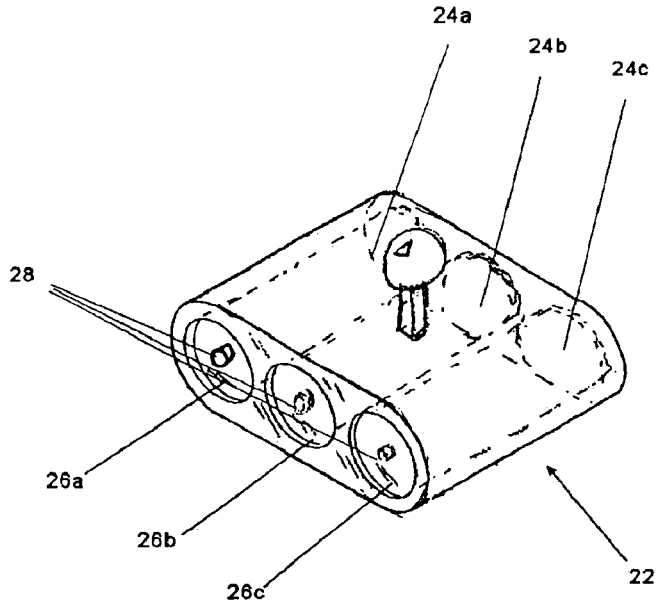
FIG. 3 is a perspective view of the primer cap holding structure end side of the exemplary moveable, muzzle loaded, black powder load chamber structure of the exemplary rifle of FIG. 1 along with an exemplary positioning and locking bar the exemplary hunting rifle of FIG. 1.
Figure 4:
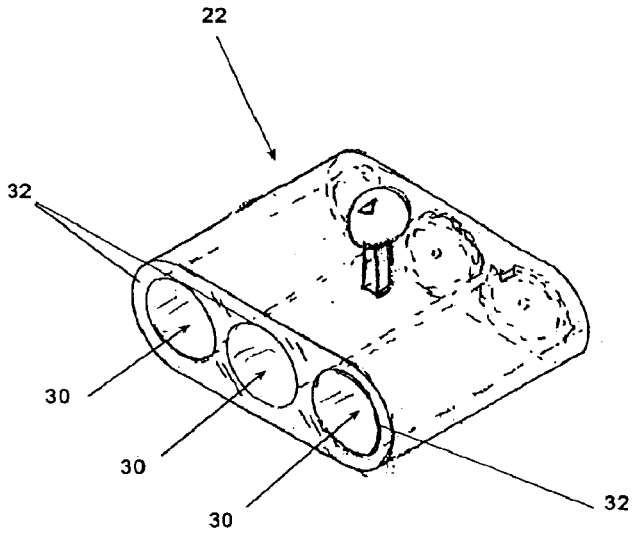
FIG. 4 is a perspective view of the chamber projectile ejection opening side of the exemplary moveable, muzzle loaded, black powder load chamber structure of the exemplary muzzle loaded, black power rifle of FIG. 1.

FIGS. 1–4 show various aspects of an exemplary embodiment of the muzzle loaded black powder hunting rifle of the present invention, generally designated 10, as well as an exemplary method of increasing the firing rate of a muzzle loaded, black powder rifle.

Muzzle loaded black powder hunting rifle, generally designated 10, includes a rifle barrel, generally designated 12, having a projectile bore 14 provided with a load chamber connecting bore end 16 and a muzzle 20; a moveable, muzzle loaded, black powder load chamber structure, generally designated 22, having multiple muzzle loaded, black powder load chamber structures 24*a*, 24*b*, 24*c* formed therein each including a separate primer cap holding structure end 26 having a primer cap holding structure 28 provided in connection therewith, a projectile load chamber 30 for holding a quantity of muzzle loaded, black powder projectile propellant and a projectile, and a chamber projectile ejection opening end 32.

Moveable, muzzle loaded, black powder load chamber structure 22 is held within a load chamber alignment and holding structure having positioning rod 33 positioned through and entrapped in a positioning and locking channel 35 formed therethrough that allows a user to selectively, rapidly, functionally connect the chamber projectile ejection opening 30 of one of the multiple muzzle loaded, black powder load chamber structures 24*a*–*c* with the projectile receiving bore end 16 of the rifle barrel projectile bore 14 and the corresponding primer cap holding structure end 26 of the selected one of the multiple muzzle loaded, black powder load chamber structures 24*a*–*c* such that the primer cap holding structure 28 is located in the striking path of a firing pin 44 of the muzzle loaded, black powder hunting rifle 10 adapted for striking and igniting a primer cap seated on the primer cap holding structure 28 in a manner to ignite a quantity of muzzle loaded, black powder projectile propellant within the projectile load chamber 30 causing a projectile inserted into the projectile load chamber 30 after the muzzle loaded, black powder propellant to be fired from the projectile load chamber 30 out of the muzzle end 32 of the rifle barrel bore 14.

An exemplary method of increasing the firing rate of a muzzle loaded, black powder hunting rifle includes the steps of: a) providing a muzzle loaded, black powder, hunting rifle 10 as described herein above; b) positioning the chamber projectile ejection opening 32 of each of the multiple muzzle loaded, black powder load chamber structures 24*a*–*c* with the projectile receiving bore end 16 of the rifle barrel projectile bore 14 and loading each of the projectile load chambers 30 with a quantity of muzzle loaded, black powder load through the muzzle end of the rifle barrel bore; c) positioning a primer cap onto the primer cap holding structure of each of the primer cap holding structure end 26*a*–*c* of the selected one of the multiple muzzle loaded, black powder load chamber structures 24*a–c*; d) positioning a projectile into each of the load chamber structures 24*a–c*; e) positioning the moveable, muzzle loaded, black powder load chamber structure 22 using positioning rod 33 to functionally connect the desired one the multiple muzzle loaded, black powder load chamber structures 24*a–c* to be fired with the rifle barrel projectile bore 20; f) causing the firing pin of the muzzle loaded, black powder hunting rifle to strike the primer cap seated on the primer cap holding structure of the first one of the multiple muzzle loaded, black powder load chamber structures firing the first one of the multiple; muzzle loaded, black powder load chamber structures; g) operating the user positionable load chamber alignment and locking mechanism to position the moveable, muzzle loaded, black powder load chamber structure to functionally connect the next one of the multiple muzzle loaded, black powder load chamber structures to be fired with the rifle barrel projectile bore 14; h) causing the firing pin 44 of the muzzle loaded, black powder hunting rifle 10 to strike the primer cap seated on the primer cap holding structure 28 of the next one of the multiple muzzle loaded, black powder load chamber structures 24*a–c* firing the next one of the multiple muzzle loaded, black powder load chamber structures 24*a–c*; and i) repeating steps f) and g) until the desired number or all of the multiple muzzle loaded, black powder load chamber structures 24*a-c* have been fired.

It can be seen from the preceding description that a method of achieving an increased muzzle loaded black powder hunting rifle firing rate as well as a muzzle loaded black powder hunting rifle that is used to practice the method have been provided.

It is noted that the embodiment of the method of increasing the firing rate of a muzzle loaded, black powder rifle and a muzzle loaded, black powder rifle for practicing the same described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A muzzle loaded black powder hunting rifle having a rapid fire rate comprising:

a rifle barrel having a projectile bore provided with a load chamber connecting bore end and a muzzle end;

a moveable, muzzle loaded black powder load chamber structure having multiple muzzle loaded black powder load chamber structures formed therein each including a separate primer cap holding structure end having a primer cap holding structure provided in connection therewith, a projectile load chamber for holding a quantity of muzzle loaded, black powder projectile propellant and a projectile, and a chamber projectile ejection opening end;

the moveable, muzzle loaded, black powder load chamber structure being held in connection with a load chamber alignment and locking structure that allows a user to selectively, rapidly, functionally connect the chamber projectile ejection opening of one of the multiple muzzle loaded black powder load chamber structures with the projectile receiving bore end of the rifle barrel projectile bore and the corresponding primer cap holding structure end of the selected one of the multiple muzzle loaded black powder load chamber structures such that the primer cap holding structure is located in the striking path of a firing pin of the muzzle loaded black powder hunting rifle adapted for striking and igniting a primer cap seated on the primer cap holding structure in a manner to ignite a quantity of muzzle loaded black powder projectile propellant within the projectile load chamber causing the projectile to be fired from the projectile load chamber out of the muzzle end of the rifle barrel bore.

2. A method of rapidly firing a muzzle loaded, black powder rifle comprising the steps of:

a) providing a muzzle loaded black powder hunting rifle including a rifle barrel having a projectile bore provided with a load chamber connecting bore end and a muzzle end; a moveable, muzzle loaded black powder load chamber structure having multiple muzzle loaded black powder load chamber structures formed therein each including a separate primer cap holding structure end having a primer cap holding structure provided in connection therewith, a projectile load chamber for holding a quantity of muzzle loaded, black powder projectile propellant and a projectile, and a chamber projectile ejection opening end; the moveable, muzzle loaded, black powder load chamber structure being held in connection with a load chamber alignment and locking structure that allows a user to selectively, rapidly, functionally connect the chamber projectile ejection opening of one of the multiple muzzle loaded black powder load chamber structures with the projectile receiving bore end of the rifle barrel projectile bore and the corresponding primer cap holding structure end of the selected one of the multiple muzzle loaded black powder load chamber structures such that the primer cap holding structure is located in the striking path of a firing pin of the muzzle loaded black powder hunting rifle adapted for striking and igniting a primer cap seated on the primer cap holding structure in a manner to ignite a quantity of muzzle loaded black powder projectile propellant within the projectile load chamber causing the projectile to be fired from the projectile load chamber out of the muzzle end of the rifle barrel bore; b) positioning the chamber projectile ejection opening of each of the multiple muzzle loaded black powder load chamber structures in connection with the projectile receiving bore end of the rifle barrel projectile bore and loading each of the projectile load chambers with a muzzle loaded black powder load through the muzzle end of the rifle barrel bore; c) positioning a primer cap in connection with the primer cap holding structure provided at a primer cap holding structure end of the selected one of the multiple muzzle loaded black powder load chamber structures; d) moving the muzzle loaded black powder load chamber structure to functionally connect the first one of the multiple muzzle loaded black powder load chamber structures to be fired with the projectile receiving bore end of the rifle barrel projectile bore; e) causing the firing pin of the muzzle loaded black powder hunting rifle to strike the primer cap seated on the primer cap holding structure of the first one of the multiple muzzle loaded black powder load chamber structures firing the first one of the multiple muzzle loaded black powder load chamber structures; f) moving the muzzle loaded black powder load chamber structure to functionally connect a second one of the multiple muzzle loaded black powder load chamber structures to be fired with the projectile receiving bore end of the rifle barrel projectile bore; g) causing the firing pin of the muzzle loaded black powder hunting rifle to strike the primer cap seated on the primer cap holding structure of the next one of the multiple muzzle loaded black powder load chamber structures firing the next one of the multiple muzzle loaded black powder load chamber structures; and h) repeating steps f) and g) until the desired number or all of the multiple muzzle loaded black powder load chamber structures have been fired.

* * * * *